US010768549B2

(12) United States Patent
Minamoto

(10) Patent No.: US 10,768,549 B2
(45) Date of Patent: Sep. 8, 2020

(54) TONER CONTAINER AND IMAGE FORMING APPARATUS

(71) Applicant: KYOCERA Document Solutions Inc., Osaka (JP)

(72) Inventor: Riku Minamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/550,339

(22) Filed: Aug. 26, 2019

(65) Prior Publication Data

US 2020/0073283 A1 Mar. 5, 2020

(30) Foreign Application Priority Data

Aug. 28, 2018 (JP) ..... 2018-159728

(51) Int. Cl.
*G03G 15/08* (2006.01)

(52) U.S. Cl.
CPC ..... *G03G 15/0889* (2013.01)

(58) Field of Classification Search
CPC ..... G03G 15/0889; G03G 15/0891
See application file for complete search history.

(56) References Cited

U.S. PATENT DOCUMENTS 8,923,734 B2 * 12/2014 Abler ..... G03G 15/08 399/262
9,134,651 B1 * 9/2015 Eto ..... G03G 15/0877
9,304,436 B2 4/2016 Eto

FOREIGN PATENT DOCUMENTS

CN 108323188 A 7/2018
JP 2015-125333 A 7/2015

OTHER PUBLICATIONS

The extended European search report issued by the European Patent Office dated Jan. 31, 2020, which corresponds to European Patent Application No. 19193008.0.

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

A toner container includes a container body having a discharging port discharging a toner, a rotating member, a moving member, a transmitting member transmitting rotation to the rotating member, an agitating member agitating the toner in the container body, and a connecting member transmitting rotation to the agitating member. At least a part of the rotating member is at least partly installed in the container body. At least a part of the transmitting member is arranged outside the container body. The rotating member includes a following coupling facing to the outside of the container body. The transmitting member includes a transmitting coupling connected to the following coupling. The agitating member includes an agitating coupling facing to the outside of the container body. The connecting member includes a connecting coupling connected to the agitating coupling. The agitating coupling is arranged outside the outer circumference of the following coupling.

12 Claims, 6 Drawing Sheets

TONER CONTAINER AND IMAGE FORMING APPARATUS

INCORPORATION BY REFERENCE

This application is based on and claims the benefit of priority from Japanese Patent application No. 2018-159728 filed on Aug. 28, 2018, the entire contents of which are incorporated herein by reference.

BACKGROUND

The present disclosure relates to a toner container and an image forming apparatus including this toner container.

Conventionally, an image forming apparatus of an electrographic manner supplies a toner from a developing device to an image carrier, such as a photosensitive drum, to thereby form a toner image. Such a toner used for forming of the toner image is generally replenished supplied from the toner container to the developing device. The toner container includes, for example, a container body having a discharging port discharging the toner and containing the toner, a rotating member installed in the container body and rotating around a rotation axis, and a moving member moving in accordance with rotation of the rotating member to convey the toner in the container body to the discharging port.

In the above-mentioned toner container, if a user rotates the rotating member in an opposite direction to an original rotating direction by mistake, the moving member is also moved in an opposite direction to an original moving direction. If such situation is caused, it is feared that distribution of the toner in the container body is varied, a stable quantity of the toner cannot be discharged from the discharging port, and toner replenishment from the toner container to the developing device becomes unstable.

SUMMARY

In accordance with an embodiment of the present disclosure, a toner container includes a container body, a rotating member, a moving member, a transmitting member, an agitating member, and a connecting member. The container body has a discharging port discharging a toner and contains the toner. The rotating member is rotated around a rotation axis extended in one direction, and at least a part of the rotating member is installed in the container body. The moving member is attached to the rotating member, is moved in the one direction in accordance with rotation of the rotating member, and conveys the toner in the container body to the discharging port. The transmitting member is connected to the rotating member, and transmits rotation to the rotating member, and at least a part of the transmitting member is arranged outside the container body. The agitating member is rotated around the rotation axis, and agitates the toner contained in the container body. The connecting member is connected to the agitating member, and transmits rotation to the agitating member. The rotating member includes a following coupling facing to the outside of the container body. The transmitting member includes a transmitting coupling connected to the following coupling. The agitating member includes an agitating coupling facing to the outside of the container body. The connecting member includes a connecting coupling connected to the agitating coupling. The agitating coupling is arranged outside the outer circumference of the following coupling.

In accordance with an embodiment of the present disclosure, an image forming apparatus includes the above-mentioned toner container, and an attached member to which the toner container is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, the entire structure of an image forming apparatus 1 according to an embodiment of the present disclosure will be described.

Hereinafter, it will be described so that the front side of the image forming apparatus 1 is positioned at a left side on a paper sheet of FIG. 1. Arrows Fr, Rr, L, R, U and Lo in each of the drawings respectively indicate a front side, a rear side, a left side, a right side, an upper side and a lower side of the printer 1.

Figure 1:
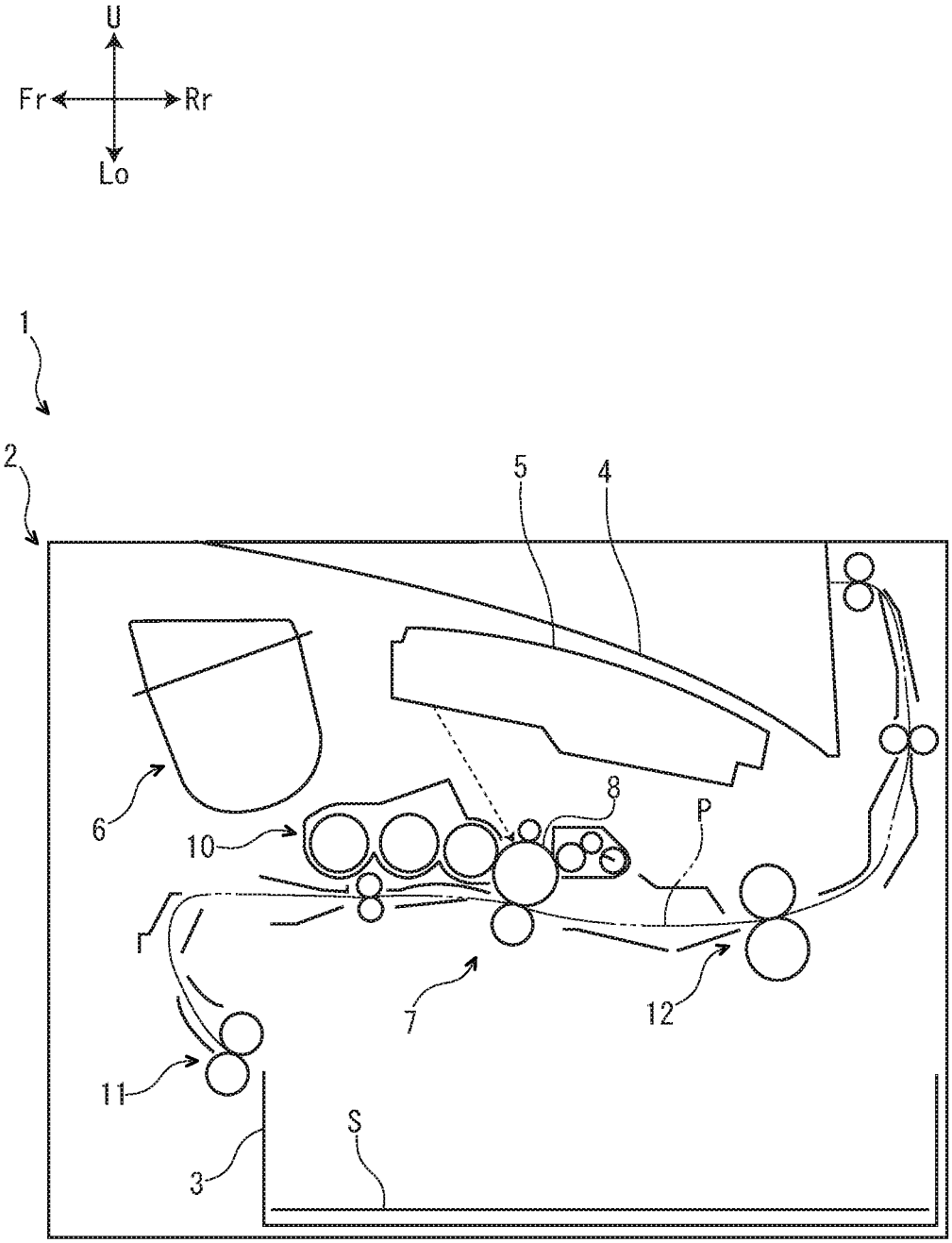
FIG. 1 is a sectional view schematically showing an image forming apparatus according to an embodiment of the present disclosure.

With reference to FIG. 1, the image forming apparatus 1 is, for example, a printer. The image forming apparatus 1 includes a box-shaped apparatus body 2. In a lower part of the apparatus body 2, a sheet feeding cartridge 3 storing sheets S (an example of a recording medium) is installed. In a top face of the apparatus body 2, an ejected sheet tray 4 is provided. In an upper part of the apparatus body 2, an exposure device 5 is installed below the ejected sheet tray 4. In an upper part of the apparatus body 2, a toner container 6 (an example of a toner containing case) is installed in front of the exposure device 5.

Inside the apparatus body 2, a conveying path P for the sheet S is arranged. At an upstream end of the conveying path P, a sheet feeding part 11 is provided. At an intermediate stream part of the conveying path P, an image forming part 7 is provided. The image forming part 7 has a photosensitive drum 8 and a developing device 10 (an example of an attached member). To the developing device 10, the toner container 6 is detachably attached. At a downstream part of the conveying path P, a fixing device 12 is provided.

Next, image forming operation of the image forming apparatus 1 having such a configuration will be described.

First, by a laser light (refer to an arrow of a broken line in FIG. 1) from the exposure device 5, an electrostatic latent image is formed on the photosensitive drum 8. Subsequently, the electrostatic latent image on the photosensitive drum 8 is developed by the development device 10, and then, a toner image is formed. Thereby, the image forming operation is completed.

On the other hand, the sheet picked up from the sheet feeding cartridge 3 by the sheet feeding part 11 is conveyed to the image forming part 7 in a timing synchronized with the above-described image forming operation. In the image forming part 7, the above-described toner image is transferred from the photosensitive drum 8 to the sheet S. The sheet S with the transferred toner image is conveyed to a downstream side on the conveying path P to enter the fixing device 12 and, in the fixing device 12, the toner image is fixed on the sheet S. The sheet S with the fixed toner image is ejected from a downstream end of the conveying path P to the sheet ejected tray 4.

Next, the toner container 6 will be further described.

An arrow I accordingly shown in FIG. 2 and later indicates an inward side in left and right directions of the toner container 6 (a side approaching the center in the left and right directions of the toner container 6), and an arrow O accordingly shown in FIG. 2 and later indicates an outward side in the left and right directions of the toner container 6 (a side separating from the center in the left and right directions of the toner container 6). An arrow R1 accordingly shown in FIG. 3 and later indicates a first rotating direction (hereinafter, called as a "first rotating direction R1"), and an arrow R2 accordingly shown in FIG. 3 and later indicates a second rotating direction opposite to the first rotating direction R1 (hereinafter, called as a "second rotating direction R2").

Figure 2:
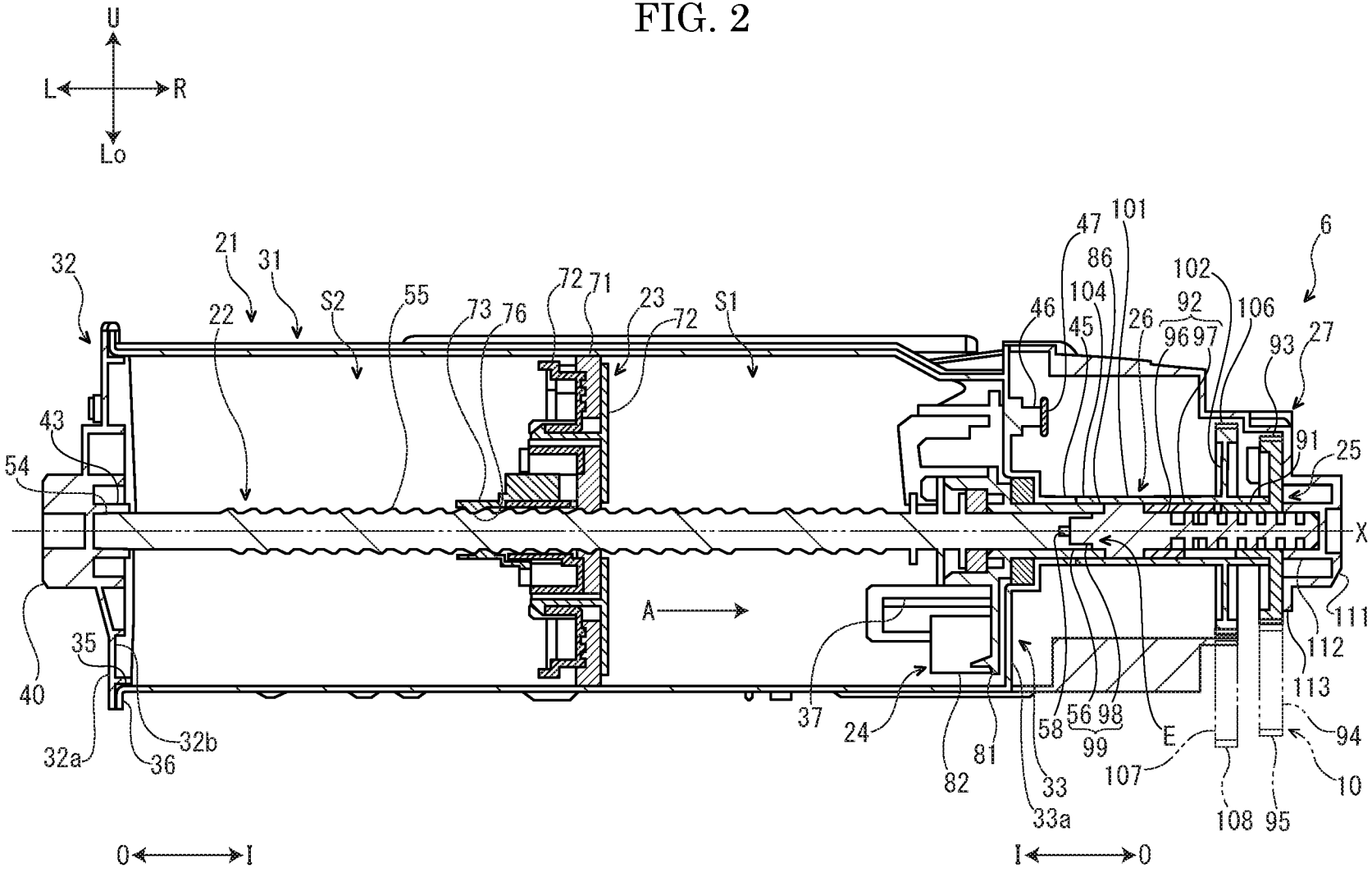
FIG. 2 is a sectional view showing a toner container according to the embodiment of the present disclosure.

With reference to FIG. 2, for the toner container 6, a rotation axis X extended in the left and right directions (an example of one direction) is set. Hereinafter, a simply described "radial direction" indicates a radial direction of a circle around the rotation axis X, and a simply described "circumference direction" indicates a circumference direction around the rotation axis X.

The toner container 6 includes a container body 21, a rotating member 22 arranged at the center of the container body 21, a moving member 23 attached on an outer circumference of the rotating member 22, an agitating member 24 attached to a right end of the container body 21, a transmitting member 25 and a connecting member 26 located at a right side (an outward side in the left and right directions) of the container body 21, and a cover 27 covering the transmitting member 25 and the connecting member 26. Hereinafter, the above-described components of the toner container 6 will be described in order.

With reference to FIG. 2, the container body 21 of the toner container 6 is formed in a box shape long in left and right directions. Inside the container body 21, a first space S1 and a second space S2 are formed. In the first space S1, the toner is contained but, in the second space S2, no toner is contained. The second space S2 is arranged at a left side of the first space S1.

The container body 21 includes a peripheral wall part 31, a lid part 32 arranged at a left side of the peripheral wall part 31, and a side wall part 33 arranged at a right side of the peripheral wall part 31.

The peripheral wall part 31 of the container body 21 is formed in a cylindrical shape and is extended in the left and right directions. In a left end of the peripheral wall part 31, an opening part 35 is provided. On an outer circumference face of the left end of the peripheral wall part 31, an annular flange part 36 is protruded around the opening part 35. In a right end of the peripheral wall part 31, a discharging port 37 discharging the toner is provided. The discharging port 37 is covered by an openable/closable shutter 38 (refer to FIG. 3).

With reference to FIG. 2, the lid part 32 of the container body 21 is arranged along a flat face orthogonal to the rotation axis X. The lid part 32 is formed separately from the peripheral wall part 31. An outer circumference portion of the lid part 32 is fixed to the flange part 36 of the peripheral wall part 31. The lid part 32 closes the opening part 35 of the peripheral wall part 31. In the center of a left face 32*a* (an outer face) of the lid part 32, a left side protruded portion 40 is protruded. In the center of a right face 32*b* (an inner face) of the lid part 32, a supporting wall 43 is protruded at the back side of the left side protruded portion 40. The supporting wall 43 is formed in an annular shape around the rotation axis X.

Figure 3:
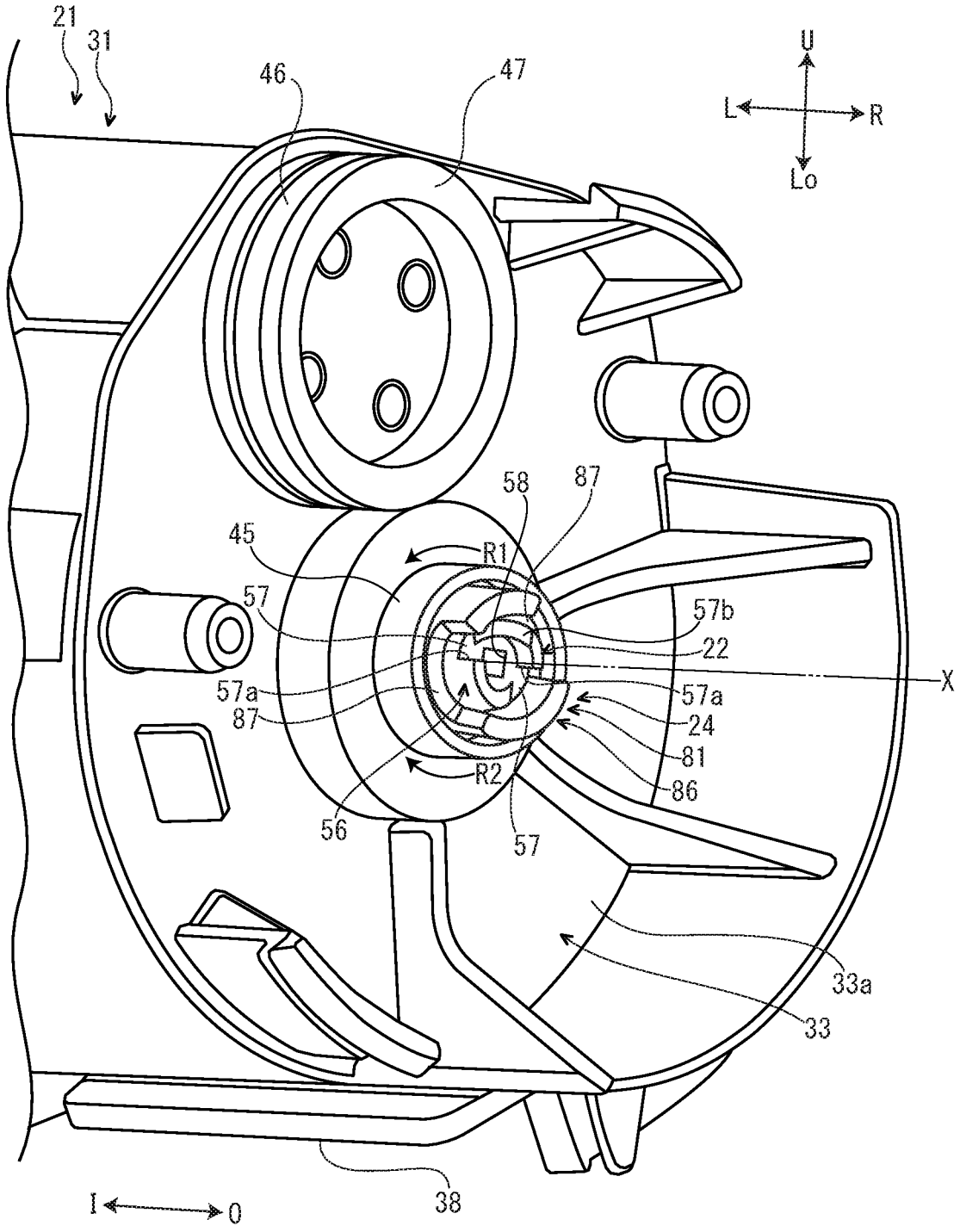
FIG. 3 is a perspective view showing a side wall part of a container body and its periphery in the toner container according to the embodiment of the present disclosure.

With reference with FIGS. 2 and 3, the side wall part 33 of the container body 21 is provided along a flat face orthogonal to the rotation axis X. The side wall part 33 is made integrally with the peripheral wall part 31 and covers a right side (an outward side in the left and right directions) of the peripheral wall part 31. In the center of a right face 33*a* (an outer face) of the side wall part 33, a bearing portion 45 is protruded. The bearing portion 45 is formed in a cylindrical shape around the rotation axis X. In an upper part of the right face 33*a* of the side wall part 33, a toner filling port 46 is protruded above the bearing portion 45, and the toner is filled in the first space S1 of the container body 21 via this toner filling port 46. The toner filling port 46 is closed by a cap 47.

With reference to FIG. 2, the rotating member 22 of the container body 21 is configured to rotate around the rotation axis X. A part other than a right end (one end in the left and right directions) of the rotating member 22 is installed in the container body 21.

The rotating member 22 is extended in the left and right directions. In a left end (the other end in the left and right directions) of the rotating member 22, a joint part 54 is provided. The joint part 54 is inserted into the supporting wall 43 arranged in the right face 32*b* of the lid part 32, and is rotatably supported by the supporting wall 43. On an outer circumference face at the center in the left and right directions of the rotating member 22, a screw part 55 is provided. A right side portion of the rotating member 22 is inserted into the bearing portion 45 arranged in the side wall part 33 of the container body 21.

With reference to FIGS. 2 and 3, in the right end (one end in the left and right directions) of the rotating member 22, a following coupling 56 is provided. The following coupling 56 faces to the outside of the container body 21. The following coupling 56 is formed so as to be along the circumference direction. In the following coupling 56, a pair of fitting gaps 57 are provided. The pair of fitting gaps 57 are arranged at opposite side to each other across the rotation axis X. At one end in the circumference direction (a downstream side end in the first rotating direction R1) of each fitting gap 57, a first following face 57*a* is formed. The first following face 57*a* is extended in the left and right directions. At the other end in the circumference direction (an upstream side end in the first rotating direction R1) of each fitting gap 57, a second following face 57*b* is formed. The second following face 57*b* is inclined relative to the left and right directions.

At the center in the radial direction of the right end of the rotating member 22, a hole part 58 having a square shaped (non-circular shaped) section is provided. The hole part 58 is located at a left side (an inward side in the left and right directions) from the following coupling 56.

With reference to FIG. 2, the moving member 23 of the toner container 6 partitions a space inside the container body 21 into the first space S1 and the second space S2 in the left and right directions. The moving member 23 is provided so as to be linearly movable in the left and right directions in a state that rotation of the moving member 23 is restricted.

The moving member 23 includes a seal piece 71, a pair of left and right sandwiching pieces 72 sandwiching the seal piece 71, and an engaging piece 73 located at a left side of the left sandwiching piece 72. An outer circumference face of the seal piece 71 is in contact with an inner circumference face of the peripheral wall part 31 of the container body 21. On an inner circumference face of the engaging piece 73, a screw groove 76 is provided. The screw groove 76 is engaged with the screw part 55 provided on the rotating member 22. Thereby, rotation of the rotating member 22 can be converted to linear movement of the moving member 23 so as to be linearly movable in the left and right directions.

With reference to FIG. 2, the agitating member 24 of the toner container 6 is relative-rotatably attached to the outer circumference of the rotating member 22. The agitating member 24 is configured to rotate around the rotation axis X. The agitating member 24 includes a holding piece 81, and a film 82 held by the holding piece 81.

In the holding piece 81 of the agitating member 24, the right side portion of the rotating member 22 is inserted. Thereby, the holding piece 81 supports the right side portion of the rotating member 22 rotatably. A left side portion of the holding piece 81 is installed in a right end of the first space S1 of the container body 21.

A right side portion of the holding piece 81 of the agitating member 24 is formed in a cylindrical shape around the rotation axis X. The right side portion of the holding piece 81 is inserted into the bearing portion 45 provided in the side wall part 33 of the container body 21. Thereby, the agitating member 24 is rotatably supported by the side wall part 33 of the container body 21.

With reference to FIGS. 2 and 3, in a right end of the holding piece 81 of the agitating member 24, an agitating coupling 86 is provided. The agitating coupling 86 faces to the outside of the container body 21. The agitating coupling 86 is formed so as to be along the circumference direction. The agitating coupling 86 is arranged outside an outer circumference of the following coupling 56. A maximum protrusion width in the left and right directions of the agitating coupling 86 relative to the right face 33*a* of the side wall part 33 of the container body 21 is larger than a maximum protrusion width in the left and right directions of the following coupling 56 relative to the right face 33*a* of the side wall part 33 of the container body 21. In the agitating coupling 86, a pair of recessed parts 87 are provided. The pair of recessed parts 87 are arranged at opposite side to each other across the rotation axis X.

With reference to FIG. 2, the film 82 of the agitating member 24 is installed in the right end of the first space S1 of the container body 21. The film 82 is made of, for example, a resin film, such as a PET film (Polyethylene Terephthalate Film), and has flexibility. A position in the left and right directions of the film 82 is overlapped with a position in the left and right directions of the discharging port 37 provided in the peripheral wall part 31 of the container body 21.

With reference to FIG. 2, the whole of the transmitting member 25 of the toner container 6 is arranged outside the container body 21. The transmitting member 25 includes a transmitting piece 91, and a ratchet mechanism 92 connecting the transmitting piece 91 and the rotating member 22.

A left side portion of the transmitting piece 91 of the transmitting member 25 is formed in a cylindrical shape around the rotation axis X. A right side portion of the transmitting piece 91 is formed in an annular shape around the rotation axis X. On an outer circumference portion of the right side portion of the transmitting piece 91, a transmitting gear 93 is provided. The transmitting gear 93 is connected to a first driving gear 95 of a first driving member 94 provided in the developing device 10.

The ratchet mechanism 92 of the transmitting member 25 includes a ratchet shaft 96, and a ratchet piece 97 provided on an outer circumference of the ratchet shaft 96.

The ratchet shaft 96 of the ratchet mechanism 92 of the transmitting member 25 is extended in the left and right directions. In a left end of the ratchet shaft 96, a transmitting coupling 98 is provided. The transmitting coupling 98 is connected to the following coupling 56 provided in the rotating member 22. Thereby, the transmitting member 25 is linearly connected to the rotating member 22, and the transmitting member 25 and the rotating member 22 are integrally rotated around the rotation axis X. The transmitting coupling 98 together with the following coupling 56 composes a restricting mechanism 99. The restricting mechanism 99 is arranged in an engaging part E of the rotating member 22 and the transmitting member 25.

Figure 4:
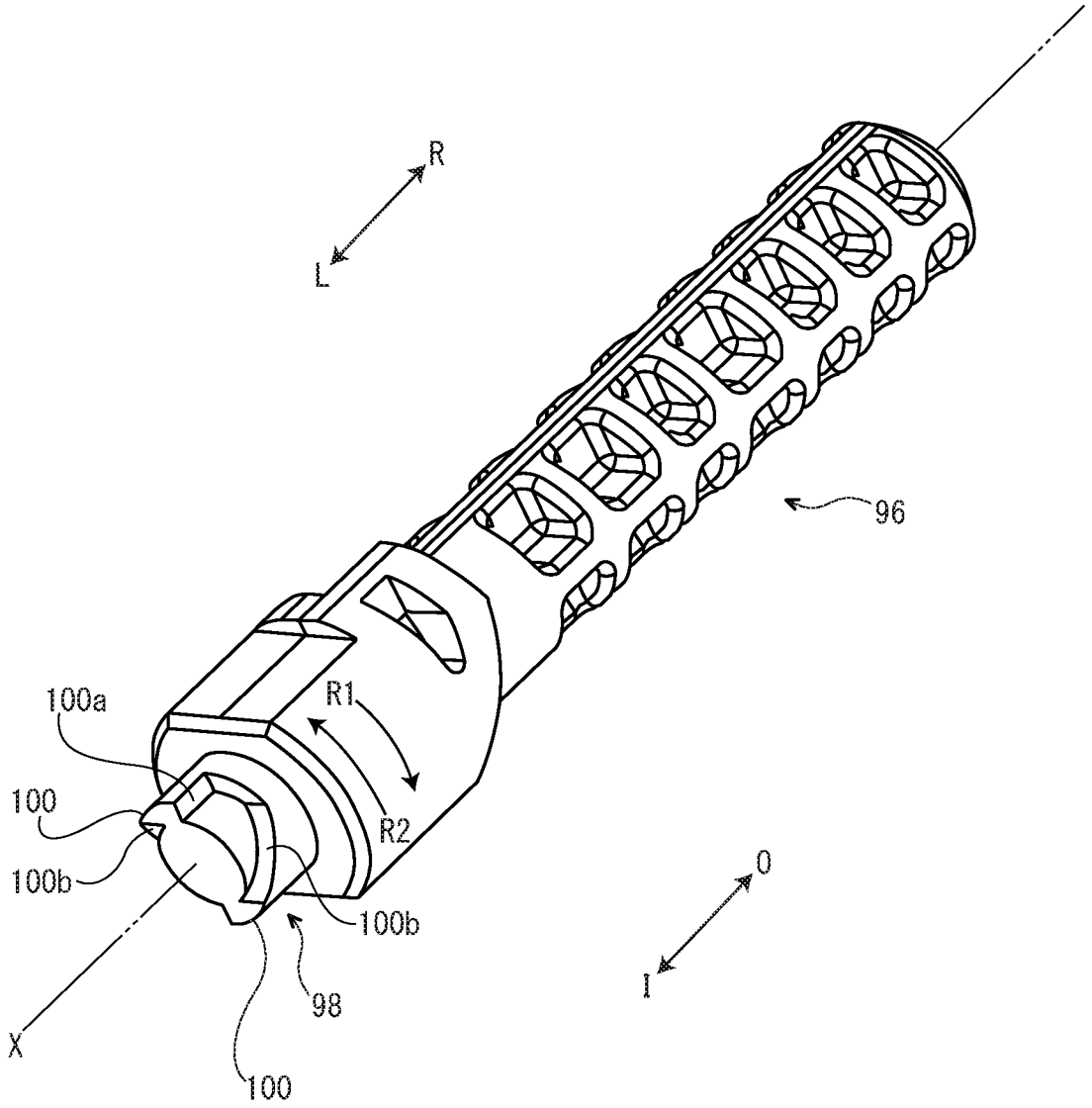
FIG. 4 is a perspective view showing a ratchet shaft in the toner container according to the embodiment of the present disclosure.

With reference to FIG. 4, in an outer circumference face of the transmitting coupling 98, a pair of fitting protrusions 100 are provided. The pair of fitting protrusions 100 are arranged at opposite side to each other across the rotation axis X. At one end in the circumference direction (a downstream side end in the first rotating direction R1) of each fitting protrusion 100, a first transmitting face 100*a* is formed. The first transmitting face 100*a* is extended in the left and right directions. At the other end in the circumference direction (an upstream side end in the first rotating direction R1) of each fitting protrusion 100, a second transmitting face 100*b* is formed. The second transmitting face 100*b* is inclined relative to the left and right directions.

With reference to FIG. 2, the ratchet piece 97 of the ratchet mechanism 92 of the transmitting member 25 is formed in a cylindrical shape around the rotation axis X. The ratchet piece 97 is arranged between the transmitting piece 91 and the ratchet shaft 96.

With reference to FIG. 2, the whole of the connecting member 26 of the toner container 6 is arranged outside the container body 21. The connecting member 26 includes a cylindrical part 101, and an annular part 102 protruded from an outer circumference face of a right side portion of the cylindrical part 101.

The cylindrical part 101 of the connecting member 26 is formed in a cylindrical shape around the rotation axis X. In a left end of the cylindrical part 101, a connecting coupling 104 is provided. The connecting coupling 104 is connected to the agitating coupling 86 provided in the holding piece 81 of the agitating member 24. Thereby, the connecting member 26 is linearly connected to the agitating member 24, and the connecting member 26 and the agitating member 24 are integrally rotated around the rotation axis X. In the connecting coupling 104, a pair of protruded parts (not shown) are provided. Each protruded part is fitted into each recessed part 87 of the agitating coupling 86.

The annular part 102 of the connecting member 26 is formed in an annular shape around the rotation axis X. On an outer circumference face of the annular part 102, a connecting gear 106 is provided. The connecting gear 106 is connected to a second driving gear 108 of a second driving member 107 provided in the developing device 10.

With reference to FIG. 2, the cover 27 of the toner container 6 is attached to the right end of the container body 21. The cover 27 covers a right side (an outward side in the left and right directions) of the side wall part 33 of the container body 21. The cover 27 covers the following coupling 56 and the agitating coupling 86.

On a right face (an outer face) of the cover 27, a right side protruded portion 111 is protruded. On a left face (an inner face) of the cover 27, a bearing portion 112 is provided at a back side of the right side protruded portion 111. The bearing portion 112 is formed in a cylindrical shape around the rotation axis X. The bearing portion 112 supports a right end of the ratchet shaft 96 of the ratchet mechanism 92 rotatably. In a lower part of the cover 27, a window portion 113 is provided, and parts of the transmitting gear 93 and the connecting gear 106 are exposed to the outside of the toner container 6 via the window portion 113.

Next, operation replenishing the toner from the toner container 6 to the developing device 10 (hereinafter, called as "toner replenishing operation") will be described.

When the toner replenishing operation is executed, a drive source (not shown) rotates the second driving member 107. When the second driving member 107 is thus rotated, this rotation is transmitted to the agitating member 24 by the connecting member 26 to rotate the agitating member 24. Thereby, the film 82 of the agitating member 24 agitates the toner contained in the first space S1 of the container body 21 and conveys this toner to the discharging port 37. The toner thus conveyed to the discharging port 37 is discharged to the outside of the container body 21 via the discharging port 37 and is replenished to the developing device 10. Thereby, the toner replenishing operation is completed.

After the toner replenishing operation as described above is executed, the toner near the discharging port 37 in the first space S1 of the container body 21 is decreased. According to this, if a toner sensor (not shown) senses that the toner near the discharging port 37 becomes less than a predetermined threshold value, a drive source (not shown) rotates the first driving member 94. When the first driving member 94 is thus rotated, this rotation is transmitted to the rotating member 22 by the transmitting member 25 to rotate the rotating member 22 in the first rotating direction R1. When the rotating member 22 is thus rotated in the first rotating direction R1, the moving member 23 attached on the outer circumference of the rotating member 22 is moved to the right side in the left and right directions (a side approaching the discharging port 37), as indicated by an arrow A in FIG. 2. According to this, a toner quantity in the first space S1 of the container body 21 is decreased, and then, the toner in the first space S1 of the container body 21 is pushed by the moving member 23 and moved to the right side (the side approaching the discharging port 37). That is, the moving member 23 conveys the toner in the container body 21 to the discharging port 37. Therefore, the toner is filled up in a space near the discharging port 37 again, and then, it is possible to replenish a sufficient quantity of the toner from the toner container 6 to the developing device 10 in next toner replenishing operation.

Incidentally, in the toner container 6 configured as described above, if a user operates the following coupling 56 by mistake to rotate the rotating member 22 in the second rotating direction R2, the moving member 23 may be moved to the left side (a side separating from the discharging port 37). If such situation is caused, it is feared that distribution of the toner in the container body 21 is varied, a stable quantity of the toner cannot be discharged from the discharging port 37, and toner replenishment from the toner container 6 to the developing device 10 becomes unstable.

However, in the present embodiment, the agitating coupling 86 is arranged outside the outer circumference of the following coupling 56. By applying such a configuration, it is possible to restrict the user from operating the following coupling 56 by mistake, and to certainly restrict rotation of the rotating member 22 in the second rotating direction R2. Moreover, even if the cover 27 is detached from the container body 21, it is possible to protect the following coupling 56 by the agitating coupling 86 against impact from the outside.

In addition, in the present embodiment, when the toner replenishing operation is executed, if the transmitting piece 91 of the transmitting member 25 is rotated in the first rotating direction R1, the ratchet piece 97 and the ratchet shaft 96 of the ratchet mechanism 92 of the transmitting member 25 is rotated in the first rotating direction R1 together with the transmitting piece 91. Therefore, the rotating member 22 connected to the ratchet shaft 96 is rotated in the first rotating direction R1 together with the ratchet shaft 96 in a body. Thus, rotation of the transmitting piece 91 is transmitted to the rotating member 22 by the ratchet mechanism 92 to rotate the rotating member 22 in the first rotating direction R1.

On the other hand, if the user rotates the transmitting piece 91 of the transmitting member 25 in the second rotating direction R2, the ratchet piece 97 of the ratchet mechanism 92 of the transmitting member 25 is rotated in the second rotating direction R2 together with the transmitting piece 91, but the ratchet shaft 96 of the ratchet mechanism 92 of the transmitting member 25 is not rotated. That is, the ratchet piece 97 is raced with respect to the ratchet shaft 96. Therefore, the rotating member 22 connected to the ratchet shaft 96 is not rotated. Thus, by the ratchet mechanism 92, transmission of rotation from the transmitting piece 91 to the rotating member 22 is intercepted, and then, rotation of the rotating member 22 in the second rotating direction R2 is restricted.

As described above, in the present embodiment, rotation of the rotating member 22 in the second rotating direction R2 is restricted by the ratchet mechanism 92. However, in a case where the user detaches the cover 27 from the container body 21 and operates the ratchet shaft 96 by mistake to rotate the ratchet shaft 96 in the second rotating direction R2, because the ratchet mechanism 92 does not work, it is feared that rotation of the rotating member 22 in the second rotating direction R2 cannot be restricted. That is, it is feared that only the ratchet mechanism 92 cannot certainly restrict rotation of the rotating member 22 in the second rotating direction R2. Thereupon, in the present embodiment, the rotating member is certainly restricted from rotating in the second rotating direction R2, as follows.

Figure 5:
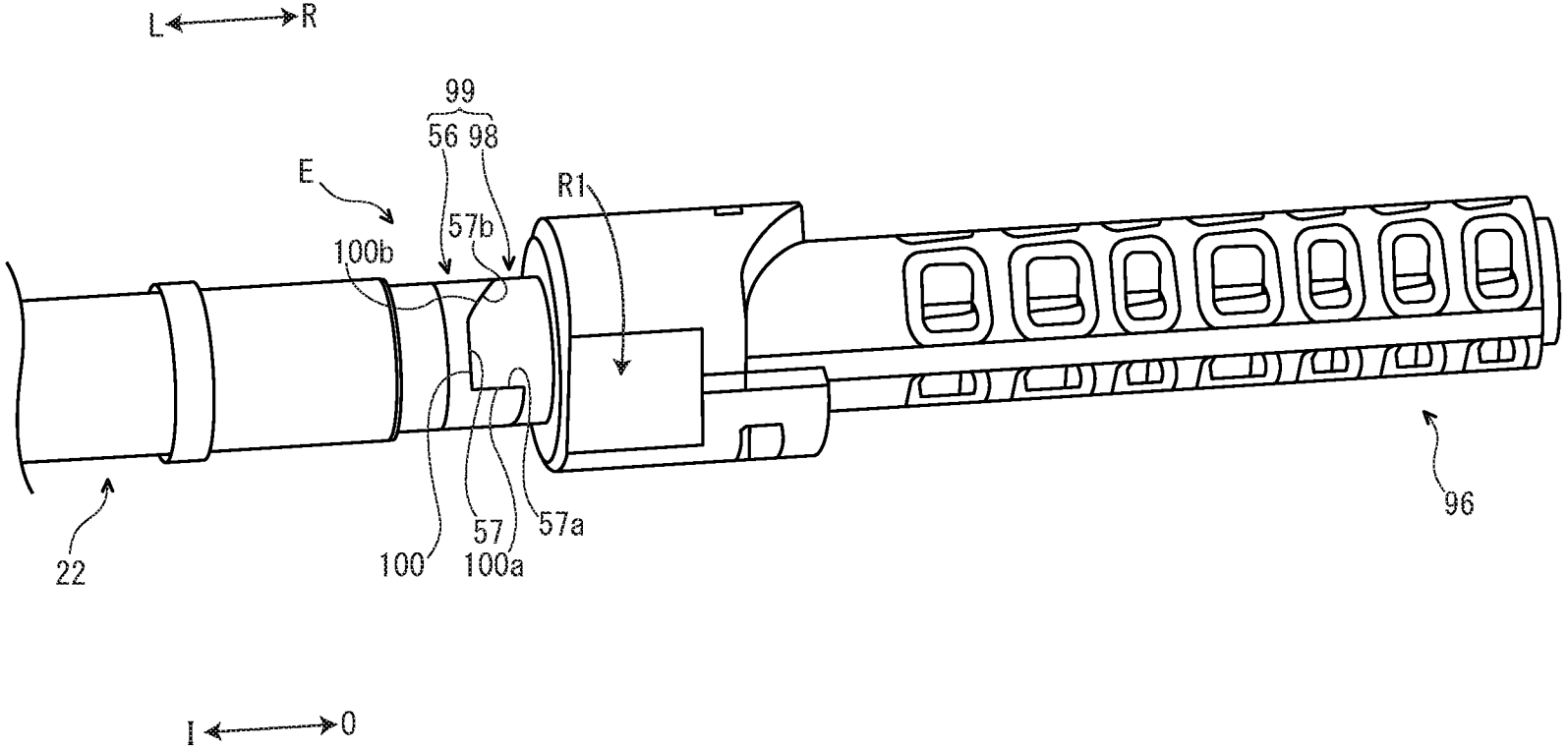
FIG. 5 is a perspective view showing the toner container, in a state that a transmitting coupling and a following coupling are connected, according to the embodiment of the present disclosure.

With reference to FIG. 5, when the toner replenishing operation is executed, in a case where the ratchet shaft 96 is rotated in the first rotating direction R1, in a state that each fitting protrusion 100 of the transmitting coupling 98 and each fitting gap 57 of the following coupling 56 are fitted, the first transmitting face 100*a* of each fitting protrusion 100 pushes the first following face 57*a* of each fitting gap 57. When the first transmitting face 100*a* thus pushes the first following face 57*a*, since the first transmitting face 100*a* and the first following face 57*a* are extended in the left and right directions, rotation of the ratchet shaft 96 is transmitted to the rotating member 22, and the rotating member 22 is rotated in the first rotating direction R1 together with the ratchet shaft 96 in a body. That is, by the restricting mechanism 99 composed of the following coupling 56 and the transmitting coupling 98, rotation of the rotating member 22 in the first rotating direction R1 is allowed.

Figure 6:
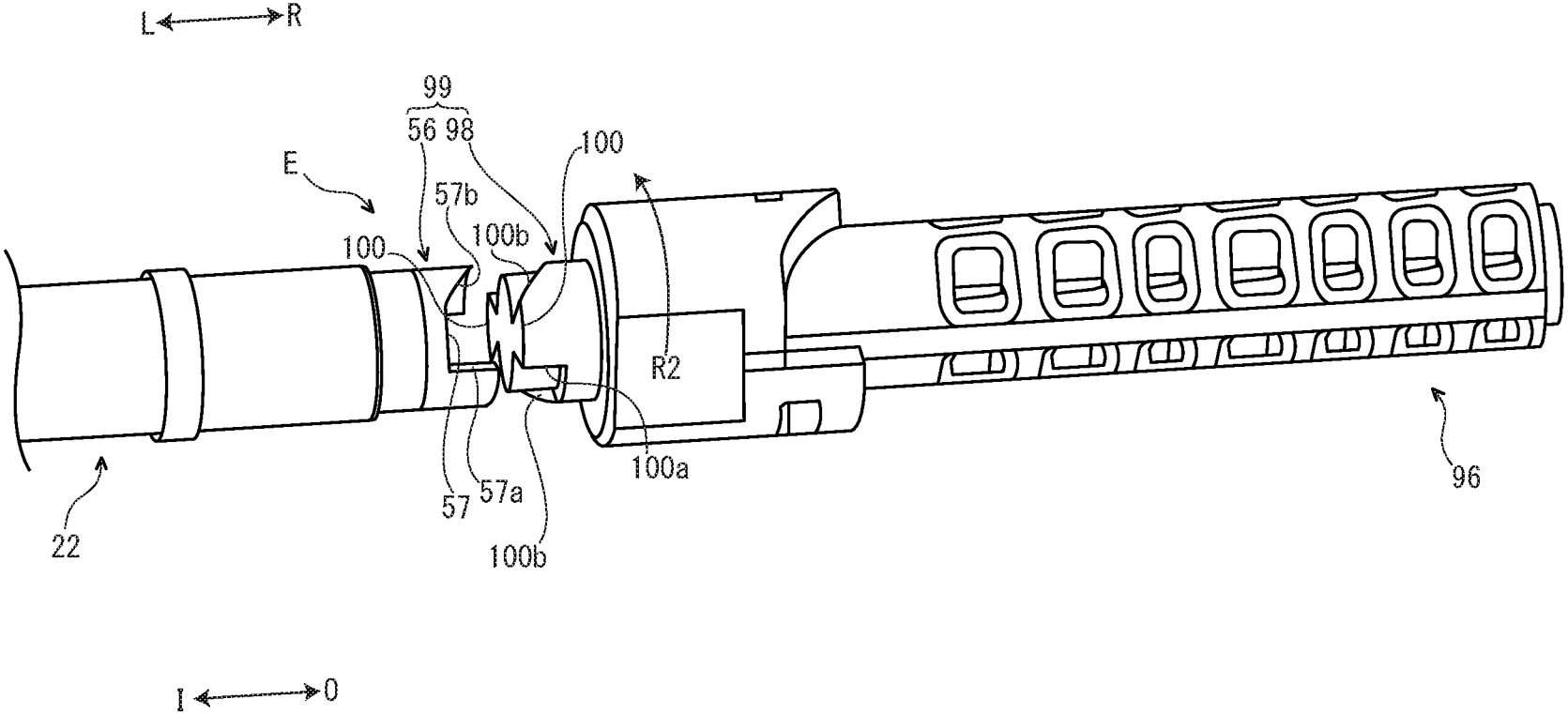
FIG. 6 is a perspective view showing the toner container, in a state that connection of the transmitting coupling and the following coupling is released, according to the embodiment of the present disclosure.

On the other hand, with reference to FIG. 6, in a case where the user makes the ratchet shaft 96 rotate in the second rotating direction R2, the second transmitting face 100*b* of each fitting protrusion 100 pushes the second following face 57*b* of each fitting gap 57. Even if the second transmitting face 100*b* thus pushes the second following face 57*b*, since the second transmitting face 100*b* and the second following face 57*b* are inclined relative to the left and right directions, rotation of the ratchet shaft 96 cannot be transmitted to the rotating member 22. Therefore, the ratchet shaft 96 is moved to a right side (an outward side in the left and right directions) with respect to the rotating member 22, fitting of each fitting protrusion 100 of the transmitting coupling 98 and each fitting gap 57 of the following coupling 56 is released, and the ratchet shaft 96 is raced with respect to the rotating member 22. That is, by the restricting mechanism 99 composed of the following coupling 56 and the transmitting coupling 98, rotation of the rotating member 22 in the second rotating direction R2 is restricted.

In the present embodiment, the restricting mechanism 99 for allowing rotation of the rotating member in the first rotating direction R1 and restricting rotation of the rotating member 22 in the second rotating direction R2 opposite to the first rotating direction R1 is provided in the engaging part E of the rotating member 22 and the transmitting member 25. By applying such a configuration, in a case where the user operates the ratchet shaft 96 by mistake to rotate the ratchet shaft 96 in the second rotating direction R2, it is possible to certainly restrict rotation of the rotating member 22 in the second rotating direction R2.

In addition, the restricting mechanism 99 is composed of the following coupling 56 and the transmitting coupling 98. By applying such a configuration, it is possible to achieve assembly of the restricting mechanism 99 only by connecting the following coupling 56 and the transmitting coupling 98. Therefore, it is facilitate assembly of the restricting mechanism 99.

Moreover, when the ratchet shaft 96 is rotated in the first rotating direction R1, the first transmitting face 100*a* pushes the first following face 57*a*, and then, the rotating member 22 is rotated in the first rotating direction R1 together with the ratchet shaft 96 in a body. On the other hand, when the ratchet shaft 96 is rotated in the second rotating direction R2, the second transmitting face 100*b* pushes the second following face 57*b*, and then, the ratchet shaft 96 is raced with respect to the rotating member 22. By applying such a configuration, it is possible to allow rotation of the rotating member 22 in the first rotating direction R1 and simultaneously to certainly restrict rotation of the rotating member 22 in the second rotating direction R2 by using a simple configuration.

Further, the maximum protrusion width in the left and right directions of the agitating coupling 86 relative to the right face 33*a* of the side wall part 33 of the container body 21 is larger than the maximum protrusion width in the left and right directions of the following coupling 56 relative to the right face 33*a* of the side wall part 33 of the container body 21. By applying such a configuration, it is possible to more effectively restrict the user from operating the following coupling 56 by mistake, and to more certainly restrict rotation of the rotating member 22 in the second rotating direction R2. Moreover, even if the cover 27 is detached from the container body 21, it is possible to more effectively protect the following coupling 56 by the agitating coupling 86 against impact from the outside.

Furthermore, the following coupling 56 and the transmitting coupling 98 are covered by the cover 27. By applying such a configuration, since it is possible to restrict the following coupling 56 and the transmitting coupling 98 from being broken by impact from the outside, it is possible to certainly work the following coupling 56 and the transmitting coupling 98.

Moreover, the ratchet mechanism 92 transmits rotation of the transmitting piece 91 to the rotating member 22 in a case where the transmitting piece 91 is rotated in the first rotating direction R1, and intercepts transmission of rotation of the transmitting piece 91 to the rotating member 22 in a case where the transmitting piece 91 is rotated in the second rotating direction R2. By applying such a configuration, it is possible to more certainly restrict rotation of the rotating member 22 in the second rotating direction R2.

Further, the image forming apparatus 1 includes the above-described toner container 6, the developing device 10 to which the toner container 6 is detachably attached. By applying such a configuration, it is possible to provide the image forming apparatus 1 including the toner container 6 being capable of certainly restricting rotation of the rotating member 22 in the second rotating direction R2.

In the present embodiment, a part (a part other than the right end) of the rotating member 22 is installed in the container body 21. However, in another embodiment, the whole of the rotating member 22 may be installed in the container body 21.

In the present embodiment, the whole of the transmitting member 25 is arranged outside the container body 21. However, in another embodiment, a part of the transmitting member 25 may be arranged outside the container body 21.

In the present embodiment, the toner container 6 is detachably attached to the developing device 10. However, in another embodiment, the toner container 6 may be detachably attached to a member other than the developing device 10 (e.g. the apparatus body 2).

In the present embodiment, the image forming apparatus 1 is the printer. However, in another embodiment, the image forming apparatus 1 may be a copying machine, a facsimile, a multifunction peripheral (an image forming apparatus compositely including a print function, a copy function, a facsimile function and others) or the like.

The above-description of the embodiment of the present disclosure was described about a preferable embodiment of the toner container and the image forming apparatus according to the disclosure. However, the technical scope of the present disclosure is not limited to the embodiments.

The invention claimed is:

1. A toner container comprising:

a container body having a discharging port discharging a toner and containing the toner;

a rotating member rotated around a rotation axis extended in one direction, wherein at least a part of the rotating member being installed in the container body;

a moving member attached to the rotating member, moved in the one direction in accordance with rotation of the rotating member, and conveying the toner in the container body to the discharging port;

a transmitting member connected to the rotating member, and transmitting rotation to the rotating member, wherein at least a part of the transmitting member being arranged outside the container body;

an agitating member rotated around the rotation axis, and agitating the toner contained in the container body; and a connecting member connected to the agitating member, and transmitting rotation to the agitating member, wherein the rotating member includes a following coupling facing to the outside of the container body, the transmitting member includes a transmitting coupling connected to the following coupling, the agitating member includes an agitating coupling facing to the outside of the container body, the connecting member includes a connecting coupling connected to the agitating coupling, the agitating coupling is arranged outside the outer circumference of the following coupling, in an engaging part of the rotating member and the transmitting member, a restricting mechanism is provided for allowing rotation of the rotating member in a first rotating direction and restricting rotation of the rotating member in a second rotating direction opposite to the first rotating direction, the restricting mechanism is composed of the following coupling and the transmitting coupling, the following coupling includes:

a first following face extended in the one direction; and a second following face inclined relative to the one direction, the transmitting coupling includes:

a first transmitting face extended in the one direction; and a second transmitting face inclined relative to the one direction, when the transmitting member is rotated in the first rotating direction, the first transmitting face pushes the first following face, and then, the rotating member is rotated in the first rotating direction together with the transmitting member in a body, when the transmitting member is rotated in the second rotating direction, the second transmitting face pushes the second following face, and then, the transmitting member is raced with respect to the rotating member.

2. The toner container according to claim 1, wherein the following coupling includes a fitting gap, the transmitting coupling includes a fitting protrusion fitted to the fitting gap, when the transmitting member is rotated in the first rotating direction, the first transmitting face pushes the first following face in a state that the fitting protrusion is fitted to the fitting gap, when the transmitting member is rotated in the second rotating direction, the second transmitting face pushes the second following face, and then fitting of the fitting protrusion and the fitting gap is released.

3. An image forming apparatus comprising:

the toner container according to claim 2; and an attached member to which the toner container is detachably attached.

4. The toner container according to claim 1, further comprising:

a cover attached to the container body, wherein the following coupling and the agitating coupling are covered by the cover.

5. An image forming apparatus comprising:

the toner container according to claim 4; and an attached member to which the toner container is detachably attached.

6. The toner container according to claim 1, wherein the transmitting member includes:

a transmitting piece on which a transmitting gear is provided; and a ratchet mechanism connecting the transmitting piece and the rotating member, the ratchet mechanism transmits rotation of the transmitting piece to the rotating member in a case where the transmitting piece is rotated in the first rotating direction, and intercepts transmission of rotation of the transmitting piece to the rotating member in a case where the transmitting piece is rotated in a second rotating direction opposite to the first rotating direction.

7. An image forming apparatus comprising:

the toner container according to claim 6; and an attached member to which the toner container is detachably attached.

8. The toner container according to claim 1, wherein the moving member partitions a space inside the container body into a first space at one end side in the one direction and a second space at the other end side in the one direction, the discharging port is provided at the one end side in the container body, the moving member is moved to the one end side in accordance with rotation of the rotating member in a first rotating direction.

9. An image forming apparatus comprising:

the toner container according to claim 8; and an attached member to which the toner container is detachably attached.

10. An image forming apparatus comprising:

the toner container according to claim 1; and an attached member to which the toner container is detachably attached.

11. A toner container comprising:

a container body having a discharging port discharging a toner and containing the toner;

a rotating member rotated around a rotation axis extended in one direction, wherein at least a part of the rotating member is installed in the container body;

a moving member attached to the rotating member, moved in the one direction in accordance with rotation of the rotating member, and conveying the toner in the container body to the discharging port;

a transmitting member connected to the rotating member, and transmitting rotation to the rotating member, wherein at least a part of the transmitting member is arranged outside the container body;

an agitating member rotated around the rotation axis, and agitating the toner contained in the container body; and a connecting member connected to the agitating member, and transmitting rotation to the agitating member, wherein the rotating member includes a following coupling facing the outside of the container body, the transmitting member includes a transmitting coupling connected to the following coupling, the agitating member includes an agitating coupling facing the outside of the container body, the connecting member includes a connecting coupling connected to the agitating coupling, the agitating coupling is arranged outside the outer circumference of the following coupling, and wherein the agitating coupling is protruded from the following coupling in the one direction relative to the outer face of the container body, and the agitating coupling covers the following coupling from an outer circumferential side of the following coupling.

12. An image forming apparatus comprising:

the toner container according to claim 11; and an attached member to which the toner container is detachably attached.

* * * * *